United States Patent [19]

Campbell

[11] 4,072,891

[45] Feb. 7, 1978

[54] TIMING DISPLAY IGNITION PLATE ASSEMBLY

[76] Inventor: Monty A. Campbell, 1518 NW. Vivian Road, Kansas City, Mo. 64118

[21] Appl. No.: 698,478

[22] Filed: June 21, 1976

[51] Int. Cl.[2] ..... F02P 17/00

[52] U.S. Cl. ..... 324/16 T; 123/146.5 A

[58] Field of Search ..... 324/16 T, 15; 123/146.5 A; 340/52 R; 73/118

[56] References Cited

U.S. PATENT DOCUMENTS

| | | | |
|---|---|---|---|
| 1,453,635 | 5/1923 | Morris | 324/16 T |
| 2,333,808 | 11/1943 | Mohnen et al. | 324/16 T |
| 2,425,081 | 8/1947 | Bohannon | 73/118 X |
| 2,774,033 | 12/1956 | Penn | 324/16 T |
| 3,375,713 | 4/1968 | Gover | 324/16 T |
| 3,411,071 | 11/1968 | Henry | 324/16 T |
| 3,505,864 | 4/1970 | Crawford | 324/16 T |
| 3,703,887 | 11/1972 | Panhard | 123/146.5 A X |
| 3,906,917 | 9/1975 | Lorti | 324/16 T X |

*Primary Examiner*—Stanley T. Krawczewicz
*Attorney, Agent, or Firm*—Fishburn, Gold & Litman

[57] ABSTRACT

A stroboscopic timing light is mounted on the ignition point carrying plate of an internal combustion engine and, when actuated, fires with a selected spark plug operating pulse, thereby illuminating marks located on an adjacent member rotating with the point breaker cam, permitting great convenience in checking and adjusting engine ignition timing.

6 Claims, 8 Drawing Figures

Fig. 1.
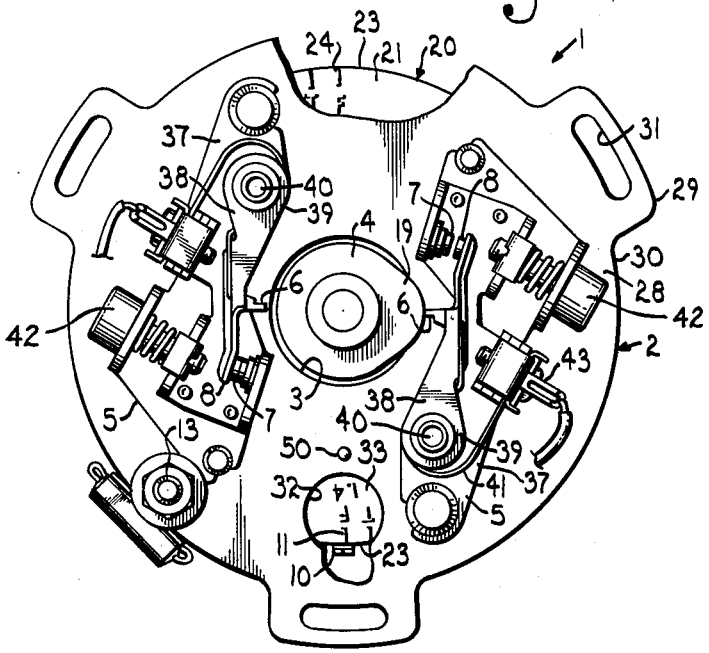
Fig. 2.
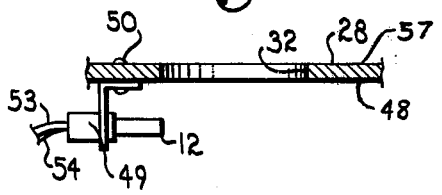
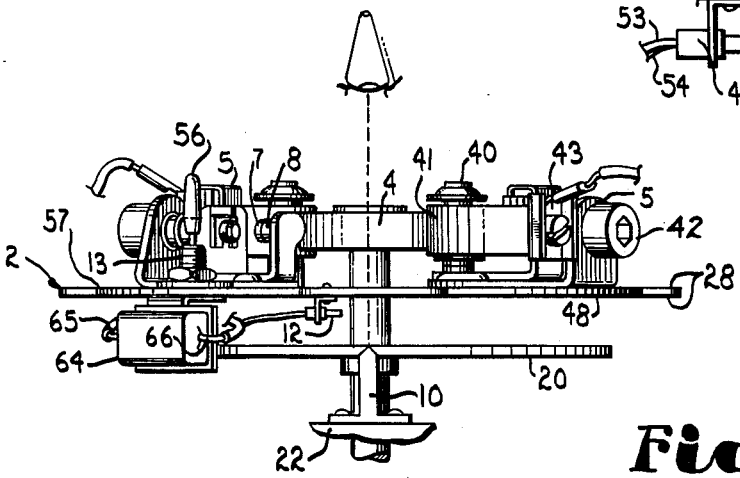
Fig. 3.

TIMING DISPLAY IGNITION PLATE ASSEMBLY

This invention relates to an apparatus for synchronizing the ignition system of a spark ignition internal combustion engine, and in particular to an ignition plate assembly having a built-in stroboscopic timing light and control switch therefor.

The principal objects of the present invention are: to provide a built-in timing light for internal combustion engines to reduce tune-up costs and provide improved convenience; to provide such an apparatus for dynamically and accurately tuning an internal combustion engine; to provide such an apparatus for turning multiple point ignition systems without an external, high voltage power source; to provide such an apparatus for the safe and quick tuning of an internal combustion engine; and to provide such an apparatus which is economical to manufacture, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features thereof.

FIG. 1 is a top plan view of an ignition assembly embodying the present invention, and a cam and rotor portion of an internal combustion engine.

FIG. 2 is a fragmentary, vertical cross-sectional view of the ignition assembly apparatus particularly showing a stroboscopic illumination portion thereof.

FIG. 3 is a side elevational view of the apparatus and a cooperating portion of the internal combustion engine.

Figure 4:
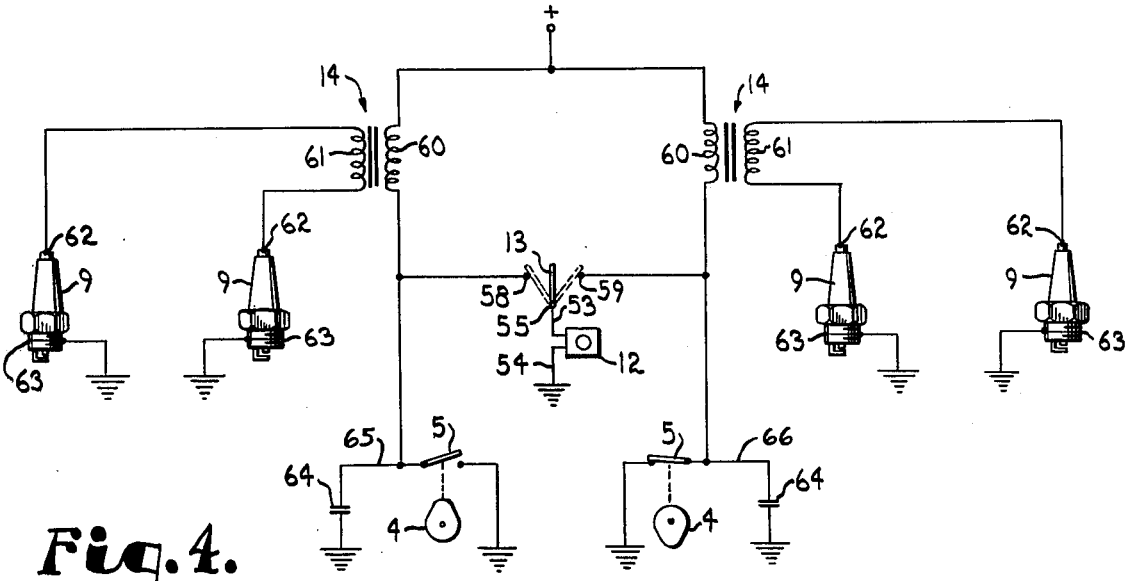
FIG. 4 is a schematic illustration of the apparatus.
Figure 5:
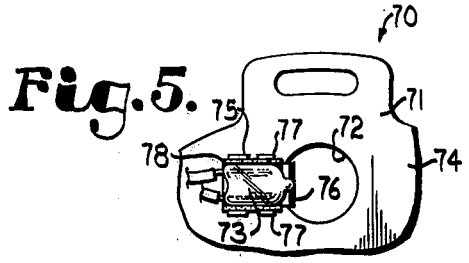
FIG. 5 is a fragmentary, bottom, elevational view of a second embodiment of the ignition assembly, particularly showing the attachment of a gas filled stroboscopic illumination device with an ignition plate.

Referring more in detail to the drawings:

The reference numeral 1 generally designates an ignition assembly for a spark ignition internal combustion engine which includes an ignition plate 2 for mounting to the engine, having a central aperture 3 with a rotating cam 4 protruding therefrom. A pair of breaker point sets 5 are attached to the ignition plate 2 and have arm portions 6 thereof slidingly engaging the cam 4 for opening and closing point members 7 and 8 and firing the engine's igniters or spark plugs 9. The point sets 5 have an angularly adjustable position with respect to the engine cam 4, and fixed and rotatable timing marks 10 and 11 respectively, are provided on appropriate engine surfaces for timing the engine's ignition system. A stroboscopic illumination device 12 has connection with the ignition plate 2 adjacent to the fixed timing mark 10 and produces a flash of light thereon in response to selected spark plug firing. The illumination device 12 has electrical connection with a switch member 13, which in turn is electrically connected to the engine's ignition coil 14 (FIG. 4), whereby in an operative switch position the illumination device flashes light onto the timing marks 10 and 11 for synchronizing the engine's ignition system.

The ignition assembly 1 is adapted for a conventional spark ignition internal combustion engine wherein the rotating cam 4 has a lobe 19 thereon, a rotor plate 20 is provided with timing marks disposed on an upper surface 21 thereof, and a spark plug 9 is disposed within each engine cylinder. The fixed timing mark or pointer 10 is rigidly attached to a stationary portion 22 of the engine adjacent to an outer edge 23 of the rotor plate 20 to facilitate the alignment of the timing marks 10 and 11. In the illustrated structure, the internal combustion engine is of the four-cycle, four-cylinder, type which is frequently used with motorcycles and other recreational vehicles. Hence, in this example, the rotor plate 20 carries an additional set of rotatable timing marks 24 for synchronizing the alternately firing engine cylinder pairs.

The ignition plate 2 has flat opposing sides 28 and a plurality of radially projecting ears 29 about an outer circumferential edge 30 thereof. Each of the ears 29 includes an arcuate, elongated slot 31 through which fasteners (not shown) are disposed and adjustably attach the ignition plate 2 to the engine. A slight aperture 32 is disposed through the ignition plate 2 adjacent to the fixed timing mark 10 and exposes the same as well as a radially outer, annular portion 33 of the rotor plate 20 on which the rotatable timing marks 11 and 24 are positioned.

The breaker point sets 5 each comprises a first portion 37 fixedly attached to the ignition plate 2 and a second portion 38 pivotally attached about one end 39 thereof to the fixed portion by a pin 40. The point members 7 and 8 are normally held in abutting contact with each other by a spring member 41. In this example, the distance between the end of the arm portion 6 and the cam lobe 19 is adjustable by means of a threaded bolt 42. The breaker point fixed portion 37 and conductive point member 7 are electrically connected with ground potential through conductive attachment with the internal combustion engine, and the breaker point pivotal portion 38 and point member 8 are electrically insulated therefrom and have electrical connection with a terminal 43. When the point members 7 and 8 are caused to diverge by the engagement of the arm portion 6 with the cam lobe 19, the electrical circuit from terminal 43 to ground potential is opened, and as will be subsequently described, causes one pair of engine spark plugs 9 to fire.

The stroboscopic illumination device 12 has electrical connection with the ignition coil 14 through switch 13 and selectively flashes short bursts of light onto the timing marks 10 and 11 for synchronizing the engine's ignition system. The illumination device 12 may take various forms, so long as short, rapid response pulse characteristics are obtained. One form utilizes a transparent bulb of the well known type having electrodes disposed therein and filled with a suitable gas, such as neon or the like. In the illustrated example of FIGS. 1–3, the illumination device 12 comprises a light emitting diode (LED). The illumination device 12 is attached to an inner surface 48 of the ignition plate, radially inwardly of the sight aperture 32 and above rotor plate 20 by a clip member 49 and fastening rivet 50. The device 12 has a pair of conductors 53 and 54 which are connected with a switch terminal 55 and ground potential respectively. The switch 13 is, in this example, a three-position switch having connection with the ignition plate 2 whereby a lever portion 56 protrudes from the plate upper surface 57 for manipulation by the user. The switch 13 has terminal 58 and 59, each of which has electrical connection with a primary side 60 of the ignition coil 14. The secondary side 61 of each ignition coil 14 has electrical connection with the center electrode 62 of a pair of spark plugs 9 having the base 63 thereof electrically connected with ground potential. A capacitor 64 has a pair of conductors 65 and 66 thereof electrically connected with switch terminals 58 and 59 respectively to prevent sparking or arcing between point members 7 and 8 as they diverge.

Figure 6:
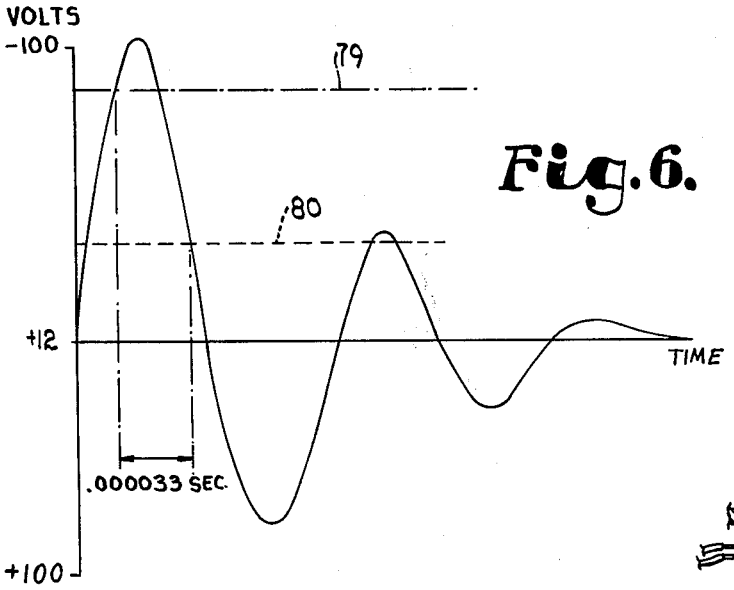
FIG. 6 is a graphic illustration of the voltage across the stroboscopic illumination device of FIG. 5 as a function of time.
Figure 7:
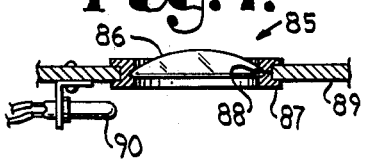
FIG. 7 is a fragmentary cross-sectional view of a third embodiment of the ignition assembly, particularly showing a lens for accurately aligning timing marks on the engine's members.
Figure 8:
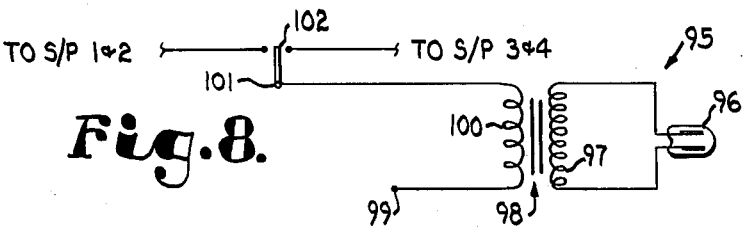
FIG. 8 is a schematic illustration of a fourth embodiment of the present invention wherein the stroboscopic illumination device is electrically connected with a secondary winding of the ignition coil.

The reference numeral 70 generally designates a second embodiment of the present invention which includes an ignition plate 71 having a slight aperture 72 therethrough and a stroboscopic illumination device 73 which, in this example, comprises a neon tube. The device 73 is disposed adjacent to the plate's lower surface 74 and is attached thereto by a clip 75. The clip has a base 76 with upstanding side walls 77 laterally engaging and frictionally retaining the device 73 therebetween. In this example, a relatively soft, spongy, cushion member 78 is disposed between the clip 75 and the device 73 and protects the same from damage caused by impact, vibration, and the like. As illustrated in the graph of FIG. 6, the device 73 is illuminated by intermittent voltage surges across the electrodes thereof, causing the gas contained therein to ionize. When the breaker points open, the circuit from the power source through the coil is broken or opened, and the voltage across the tube electrodes increases rapidly past the voltage level 79 at which the gases will ionize. The capacitor 64 then begins to discharge, causing the voltage to drop to a positive value and oscillate in a dampened fashion. As the voltage falls below that level required to maintain ionization, in FIG. 6 the broken line designated 80, illumination ceases. In the illustrated graph (FIG. 6), the neon bulb is illustrated for a period of only 0.000033 ($3.3 \times 10-5$) seconds.

The reference numeral 85 generally designates a third embodiment of the present invention wherein a lens 86 is disposed within a grommet 87 and positioned within the sight aperture 88 of the ignition plate 89. The lens 86 facilitates accurate timing by assisting in the alignment of the fixed and rotating timing marks when the illuminating device 90 flashes.

The reference numeral 95 gemerally designates a fourth embodiment of the present invention wherein the illumination device 96 has electrical connection with the secondary side 97 of the ignition coil 98. Terminal 99 of the primary coil side 100 has electrical connection with the breaker points (not shown) and primary coil side terminal 101 has connection with the switch 102, which, in turn, has connection with the spark plugs (not shown but designated by "to S/P 1 & 2" and "to S/P 3 × 4").

The ignition assembly 1 is installed and attached to the internal combustion engine in a conventional fashion. When the engine is to be timed, the user first removes the cover (not shown) from the ignition plate 2. The engine speed is then set at a level predetermined in accordance with the specific engine to be timed, by a gauging device such as a built-in tachometer. The switch lever 56 is then manipulated to make or complete a circuit with the primary side 60 of one of the ignition coils 14, whereby the stroboscopic illumination device 12 produces a burst of light ech time the spark plugs 9 associated with the selected coil are fired. With the engine running, the user looks through the sight aperture 32 along a line substantially perpendicular to the rotor 20 as illustrated by the broken line in FIG. 3. The breaker point adjuster 42 associated with the selected coil is then selectively rotated until the rotatable timing mark associated with those cylinders are aligned with the fixed timing mark 10. The user manipulates the switch to the second operating position and similarly synchronizes the remaining cylinders. By flipping the switch 13 from connection with terminal 58 to terminal 59, and adjusting the breaker points 5 for the relative alignment of the fixed and rotatable timing marks 10, 11 and 24 respectively, the user is assured that the various engine cylinders are mutually synchronized. The switch is returned to its inoperative position and the ignition cover is reattached to the engine.

It is to be understood that while certain forms of this invention have been illustrated and described, it is not to be limited to the specific form or arrangement of parts herein described and shown, except insofar as such limitations are included in the following claims.

What is claimed and desired to be secured by Letters Patent is:

1. An ignition assembly for use on a multi-cylinder internal combustion engine having a spark ignition system including electrical power means, a coil with primary and secondary elements, a spark plug for each cylinder, a rotating cam having a first and second timing mark thereon and a reference timing mark fixedly disposed on said engine, said ignition assembly comprising:

a. an ignition plate having a central aperture therethrough and mountable on said engine whereby said cam is disposed within and protruding from said aperture;

b. a first and second pair of adjustable breaker points mounted on said ignition plate and respectively adapted for timing a first and second cylinder of said engine;

c. one point of each of said pairs of breaker points comprising a first portion fixedly attached to said ignition plate with a first point member adjustable on said fixedly attached first portion; a threaded bolt operably connected between said fixedly attached first portion and said first point member to effect an adjustment therebetween in response to rotation of said threaded bolt;

d. the other point of each of said pairs of breaker points comprising a second point member pivotally mounted at a point fixed with respect to said ignition plate and having a spring loaded arm portion adapted for slidable cam engagement to open and close said first and second point members; said threaded bolt, in effecting said adjustment, adjusting the dwell between said first and second point members;

e. built-in dynamic stroboscopic illumination means having mechanical connection with said ignition plate and electrical connection with said first and second pair of breaker points whereby in operation in said engine said illumination means produces a flash of light in response to engine operated breaker point function;

f. said built-in illumination means including a multiple position switch having electrical connection between said first and second pair of breaker points and said illumination means, said switch being selectively movable from an off position wherein said illumination means is rendered inoperative to a respective first and second on position wherein said first and second pairs of breaker points selectively actuate said illumination means;

g. timing mark viewing means associated with said ignition plate, said built-in illumination means being located on said ignition plate in conjunction with said viewing means to illuminate and expose to view said first and second timing marks and reference timing mark during engine operation, whereby said first and second pairs of breaker points are independently adjustable in absence of external equipment and during engine operation by selectively moving said switch to the respective on positions and rotating the respective bolts until said first and second timing marks are properly aligned with said reference timing mark.

2. An ignition assembly as set forth in claim 1 wherein:

a. said stroboscopic illumination means has electrical connection with the primary element of said coil.

3. An ignition assembly as set forth in claim 1 wherein:

a. said stroboscopic illumination means comprises a light emitting diode (LED).

4. An ignition assembly as set forth in claim 1 wherein:

a. said stroboscopic illumination means comprises a gaseous discharge lamp;

b. said connecting means comprises a U-shaped clip; and c. a cushion member is disposed between said lamp and said clip protecting said lamp from damaging vibration and impact.

5. An ignition assembly as set forth in claim 1 wherein:

a. said viewing means comprises a sight aperture through said ignition plate.

6. An ignition assembly as set forth in claim 5 including:

a. a lens mounted within said sight aperture and magnifying the size of said first and second timing marks.

* * * * *